United States Patent [19]

Nicoll

[11] Patent Number: 4,854,773

[45] Date of Patent: Aug. 8, 1989

[54] BEACH CARPET

[76] Inventor: James D. Nicoll, 829 Randall, Troy, Mich. 48098

[21] Appl. No.: 208,999

[22] Filed: Jun. 20, 1988

[51] Int. Cl.[4] ..... E02B 3/12

[52] U.S. Cl. ..... 405/19; 405/15; 47/9

[58] Field of Search ..... 405/15, 16, 17, 19; 47/1.4, 9, 33

[56] References Cited

U.S. PATENT DOCUMENTS

| | | | |
|---|---|---|---|
| 2,390,403 | 12/1945 | Van Der Rest | 405/17 |
| 2,435,568 | 2/1948 | Anderson | 405/17 |
| 2,570,271 | 10/1951 | Pickett | 405/19 X |
| 3,561,219 | 2/1971 | Nishizawa et al. | 405/19 |
| 3,696,623 | 10/1972 | Heine et al. | 405/19 |
| 3,837,169 | 9/1974 | Lamberton | 405/19 X |
| 3,922,865 | 12/1975 | Nijdam | 405/17 |
| 3,928,978 | 12/1975 | Larsen | 405/25 |
| 3,934,421 | 1/1976 | Daimler et al. | 405/16 |
| 4,407,606 | 10/1983 | Larsen | 405/17 |
| 4,518,280 | 5/1985 | Fletcher | 405/15 X |
| 4,577,996 | 3/1986 | Elias et al. | 405/17 |

FOREIGN PATENT DOCUMENTS

| | | | |
|---|---|---|---|
| 1931537 | 8/1978 | Fed. Rep. of Germany | 405/19 |
| 2217970 | 9/1974 | France | 405/19 |

*Primary Examiner*—Randolph A. Reese
*Assistant Examiner*—Arlen L. Olsen
*Attorney, Agent, or Firm*—Krass & Young

[57] ABSTRACT

Accordingly, the present invention provides a strip stored as a roll and adapted to be unrolled along a support surface supporting a fluid. The strip includes a flexible matrix and a plurality of weighted material dispensed through the matrix and secured therein and having a predetermined weight to allow the strip to rest upon a support surface supporting a fluid thereon.

7 Claims, 1 Drawing Sheet

FIG. 1
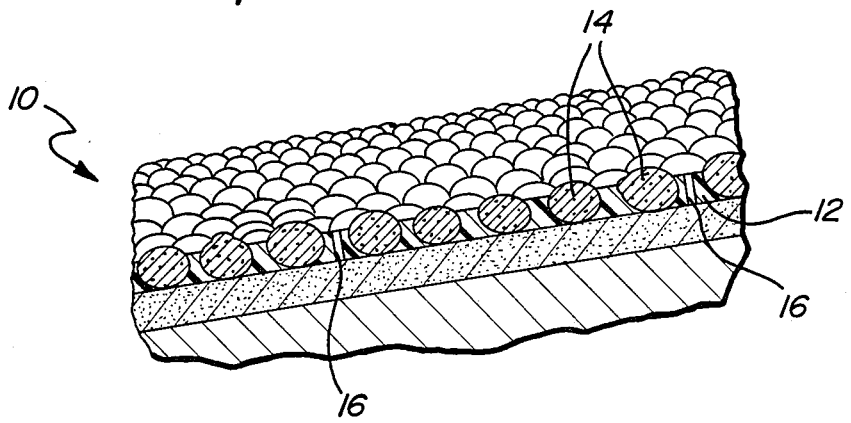
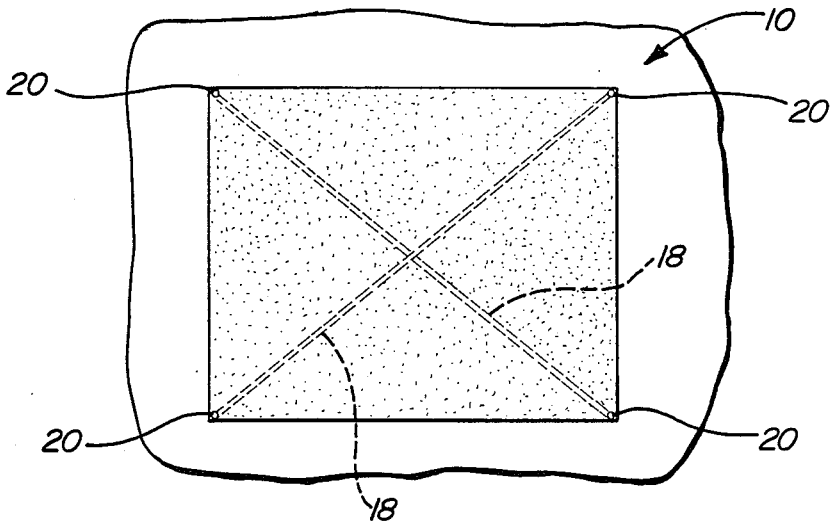
FIG. 2
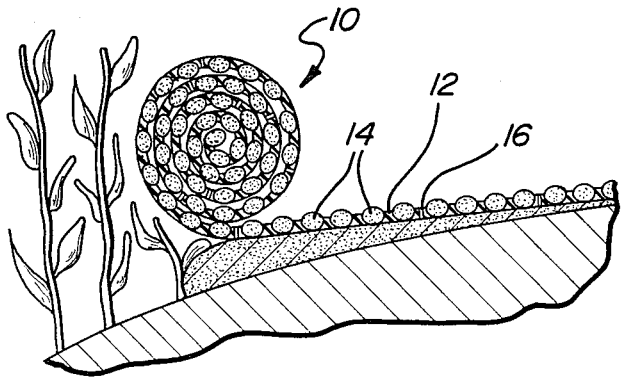
FIG. 3

BEACH CARPET

BACKGROUND OF THE INVENTION

1. FIELD OF THE INVENTION

The subject invention relates to a strip stored as a roll and adapted to be unrolled along a bed of a body of water for preventing growth of aquatic weeds.

2. DESCRIPTION OF RELATED ART

Living beside a freshwater lake presents a myriad of problems. These problems include rampant weed growth and muck, murky, leech-infested mud bottoms. While wading out for a swim through dark tangles of weeds is a psychologically shattering, if not altogether prohibitive, experience, it is certainly a dangerous one. Many drownings occur annually in weedy inland waters. Further, most lake bottoms that exhibit such weed growth also harbor mud or silt bottoms, which are an ideal habitat for leeches or "blood-suckers," the absolute terrifying end-all for most people and virtually all children. Another problem is that weeds can also choke waterways in little canals or near docks to the point of impeding or prohibiting the passage of pleasure craft. An additional problem is one of simple aesthetics. Obviously, a sandy beach which extends out a distance into the water not only feels better on the feet, it is more visually appealing as well. Not only can you see your feet and where you are walking (taking away the "fear of the unknown"), but a light colored bottom also lets you see fish in visual relief. Thus, the aesthetics appearance invites an underwater swim.

One attempted solution to this problem is to disclosed in U.S. Pat. No. 4,518,280, issued May 21, 1985, in the name of Eldon L. Fletcher. This patent discloses a film of a thermoplastic synthetic polymer with a plurality of cross-shaped incisions therein. The incisions permit decomposition gases to escape by lifting the flaps. The film is dropped to the bottom of the water and pulled across the bed by ropes attached to the ends of the rotatable cord. Thus, the bed or bottom of the water body, as wide as a roll of film, is covered.

The problem with this approach is that the film is thin and susceptible to being torn. Also, the film is weighted at intervals using rocks which may be dislodged allowing the film to move or escape, thereby defeating its purpose. Additionally, the flaps may become locked in one position due to debris and other material in the water, causing the flap to remain closed and trapping any gases underneath the film.

SUMMARY OF THE INVENTION

Accordingly, the present invention provides a strip stored as a roll and adapted to be unrolled along a support surface supporting a fluid. The strip includes a flexible matrix and a plurality of weighted material dispensed through the matrix and secured therein and having a predetermined weight to allow the strip to rest upon the support surface supporting a fluid thereon to prevent growth of aquatic weeds and present an aesthetics appearance.

Accordingly, the present invention provides the advantages of a carpet of smooth gravel held in a matrix of tough, flexible polymer to prevent growth of aquatic weeds. The weight of the carpet will remain in place on the bed of the water body. Also, the present invention includes small holes placed in the polymer matrix for allowing gases generated by decomposing flora and other sources to escape upwards without eventually building up and "floating" or shifting the carpet. As the carpet slowly settles after crushing out weed growth, it begins to squeeze out water from the underlying muck and silt, thus firming up the entire "floor" of the underwater beach.

BRIEF DESCRIPTION THE DRAWINGS

Other advantages of the present invention will be readily appreciated as the same becomes better understood by reference to the following detailed description when considered in connection with the accompanying drawings wherein:

FIG. 1 is an elevational view of the present invention;

FIG. 2 is a plan view of the subject invention; and

FIG. 3 is an elevational view of the subject invention installed along the bottom of a body of water.

DESCRIPTION OF THE PREFERRED EMBODIMENT

A strip stored as a roll and adapted to be unrolled along a support surface supporting a fluid is generally shown at 10 in FIGS. 1 through 3. The strip 10 may be called a "beach carpet" which is unrolled along the bottom of a body of water such as a lake. The strip 10 comprises a matrix 12 made of a tough, flexible, polymer material. The strip 10 includes a plurality of weighted material 14 such as gravel dispensed throughout the matrix 12 and held therein by the bonding action of the polymer. The weighted material 14 of gravel has a predetermined weight to allow the strip 10 to rest upon the support surface supporting the water. The manageable, but measurable weight of the strip 10 slowly mats down weed growth, eventually killing it due to a lack of light and space. At least one, preferrably a plurality of, apertures 16 are formed in the matrix 12 and communicate therethrough to vent gases between the strip 10 and the support surface of the fluid. In other words, the apertures 16 formed in the matrix 12 allow gases generated by decomposing flora and other sources to escape upwards through the strip 10 without eventually building up and "floating" or shifting the strip 10. The weighted material 14 can come in many different sizes, textures, and colors as can the matrix 12. Further, the upper surface of the matrix 12 may be impregnated with another material such as sand to give a more appealing aesthetics surface. This might be done for just "feel" or to serve as an "anchoring" surface should a light layer of "loose" sand wish to be added.

As illustrated in FIG. 2, the strip 10 can also be made easily removeable, by embedding cables 18 on the fringes and bias coupled to eye hooks 20.

In operation, as illustrated in FIG. 3, the strip 10 would be stored as a roll. The strip 10 is then unrolled outwards from the beach to the water to any desired distance. As the strip 10 slowly settles after crushing out weed growth, it begins to squeeze out water from underlying muck and silt, thus firming up the entire "floor" of the underwater beach. To remove the strip 10, any vehicle could be attached to the eye hooks 20 to pull the strip 10 from the water.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

What is claimed is:

1. A flexible, rollable mat adapted to be unrolled along a surface supporting a body of water, said mat comprising:

a flexible, generally sheet-like matrix fabricated from a polymeric material and having a plurality of discrete particles of a weighting material retainably embedded therein, the density and amount of said weighting material being sufficient to cause the mat to sink beneath the body of water; said mat further including a plurality of spaced apart openings extending therethrough and configured to allow passage of water and gas therethrough.

2. A mat as in claim 1, wherein the density and amount of weighting material confers sufficient density to the mat so as to cause compression of the surface upon which it is disposed so that water is displaced therefrom and said surface is firmed.

3. A mat as in claim 1, wherein said weighting material is gravel.

4. A mat as in claim 1, further including a layer of sand retainably embedded on one surface thereof such that a texture is imparted to that surface.

5. A mat as in claim 1, further including a plurality of cables embedded in the matrix.

6. A mat as in claim 5, further including attachment means connected to the cables.

7. A mat as in claim 6, wherein said attachment means comprises an eye hook.

* * * * *